US009854636B2

(12) United States Patent
Abele et al.

(10) Patent No.: US 9,854,636 B2
(45) Date of Patent: Dec. 26, 2017

(54) LIGHTING DEVICE AND METHOD FOR OPERATING A LIGHTING DEVICE

(71) Applicant: Panasonic Corporation, Osaka (JP)

(72) Inventors: Manfred Abele, Ruppertshofen (DE); Martin Bulling, Schwaebisch Gmuend (DE); Jens Lander, Schorndorf (DE)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 14/909,501

(22) PCT Filed: Nov. 25, 2013

(86) PCT No.: PCT/JP2013/006913

§ 371 (c)(1),
(2) Date: Feb. 2, 2016

(87) PCT Pub. No.: WO2015/075764

PCT Pub. Date: May 28, 2015

(65) Prior Publication Data

US 2016/0174322 A1 Jun. 16, 2016

(51) Int. Cl.
*H05B 37/02* (2006.01)
*H05B 33/08* (2006.01)
(Continued)

(52) U.S. Cl.
CPC ..... *H05B 33/0854* (2013.01); *F21V 29/67* (2015.01); *F21V 29/70* (2015.01); *F21V 29/90* (2015.01)

(58) Field of Classification Search
CPC .. H05B 37/02; H05B 1/0244; H05B 33/0815; H05B 33/0818; H05B 33/0827;
(Continued)

(56) References Cited

U.S. PATENT DOCUMENTS 6,191,541 B1 * 2/2001 Patel ..... H05B 33/0854 315/307
8,384,290 B2 2/2013 Tsai
(Continued)

FOREIGN PATENT DOCUMENTS

DE 102009041957 A1 3/2010
DE 202011000764 U1 7/2011
(Continued)

OTHER PUBLICATIONS

Author: Miyazaki Nobuo, Title: Device and method for controlling lamp illuminacen, and color thermal printer, Date:Oct. 31, 2000 (Original).*

(Continued)

*Primary Examiner* — Douglas W Owens
*Assistant Examiner* — Wei Chan
(74) *Attorney, Agent, or Firm* — Renner Otto Boisselle & Sklar, LLP

(57) ABSTRACT

The present invention refers to a lighting device (10) and a method of operating this lighting device (10). A lighting module (13) having a light element series connection (15) of several semiconductor light elements (14) is connected to the output (12) of a drive circuit (11). The control means (20) is provided which is configured to adapt a heating condition if a heating requirement is fulfilled. In the heating condition a heating means (26) is activated by the control means (20) to heat the lighting module. The heating requirement is fulfilled when the temperature (T) of the lighting module (13) drops down to a minimum temperature value (Tmin). In so doing an undesired increase of the forward voltage (Vf) of the light element series connection (15) can be avoided.

11 Claims, 5 Drawing Sheets

(51) Int. Cl.
*F21V 29/67* (2015.01)
*F21V 29/70* (2015.01)
*F21V 29/90* (2015.01)

(58) Field of Classification Search
CPC ..... H05B 33/0863; H05B 33/0872; H05B 37/0245; H05B 37/029; H05B 3/56; G05F 1/00
USPC ..... 315/186, 185 R, 276, 287, 291; 250/205, 250/226
See application file for complete search history.

(56) References Cited

U.S. PATENT DOCUMENTS

2004/0113044 A1* 6/2004 Ishiguchi ..... H05B 33/0872 250/205
2007/0108843 A1* 5/2007 Preston ..... H05B 33/083 307/112
2007/0109763 A1* 5/2007 Wolf ..... A01M 1/2083 362/86
2008/0231198 A1* 9/2008 Zarr ..... H05B 33/089 315/119
2009/0323238 A1* 12/2009 Gehrke ..... H05B 33/089 361/56
2010/0231136 A1* 9/2010 Reisenauer ..... H05B 33/0848 315/276
2011/0101883 A1* 5/2011 Grajcar ..... A01K 29/00 315/291
2011/0241548 A1* 10/2011 Tsai ..... H05B 33/0842 315/117
2011/0260633 A1* 10/2011 Takeda ..... H05B 33/0815 315/192
2011/0273098 A1* 11/2011 Grajcar ..... H05B 33/0809 315/186
2012/0161638 A1* 6/2012 Ohiro ..... H05B 33/083 315/122
2012/0262074 A1* 10/2012 Wang ..... H05B 33/083 315/186
2014/0111090 A1* 4/2014 Zhang ..... H05B 33/0815 315/122
2016/0050725 A1* 2/2016 Johnston ..... H05B 33/0851 315/122

FOREIGN PATENT DOCUMENTS

JP 2013-502081 A 1/2013
WO WO 2011/020007 A1 2/2011

OTHER PUBLICATIONS

Author: Miyazaki Nobuo, Title: Device and method for controlling lamp illuminacen, and color thermal printer, Date:Oct. 31, 2000 (Translation).*
International Search Report and Written Opinion for corresponding International Application No. PCT/JP2013/006913 dated Aug. 21, 2014.
Japanese Office Action dated Jan. 17, 2017 for corresponding Japanese Application No. 2015-553341.

* cited by examiner

[Fig. 1]
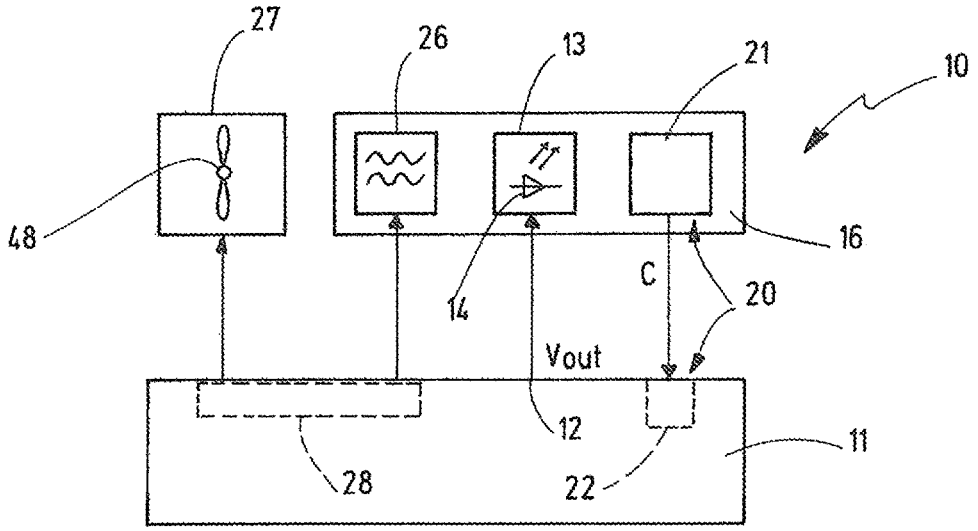
[Fig. 2]
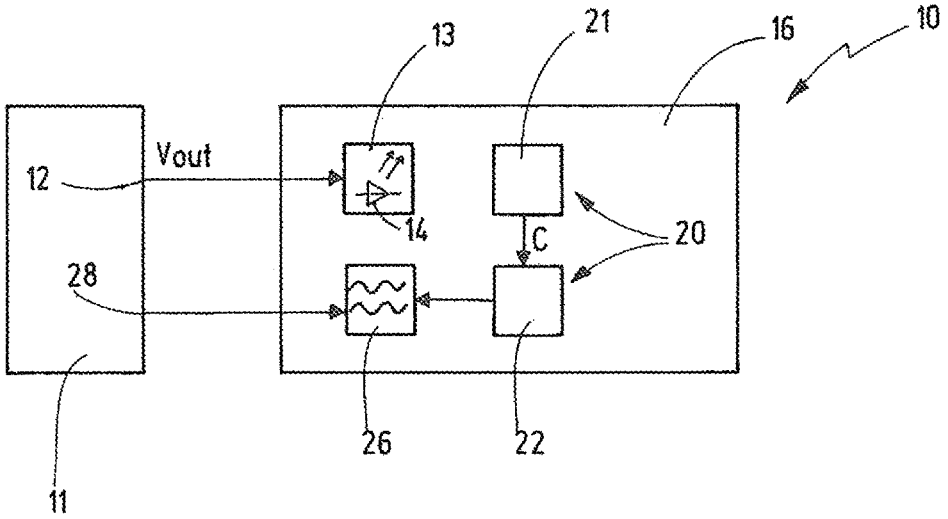

[Fig. 3]
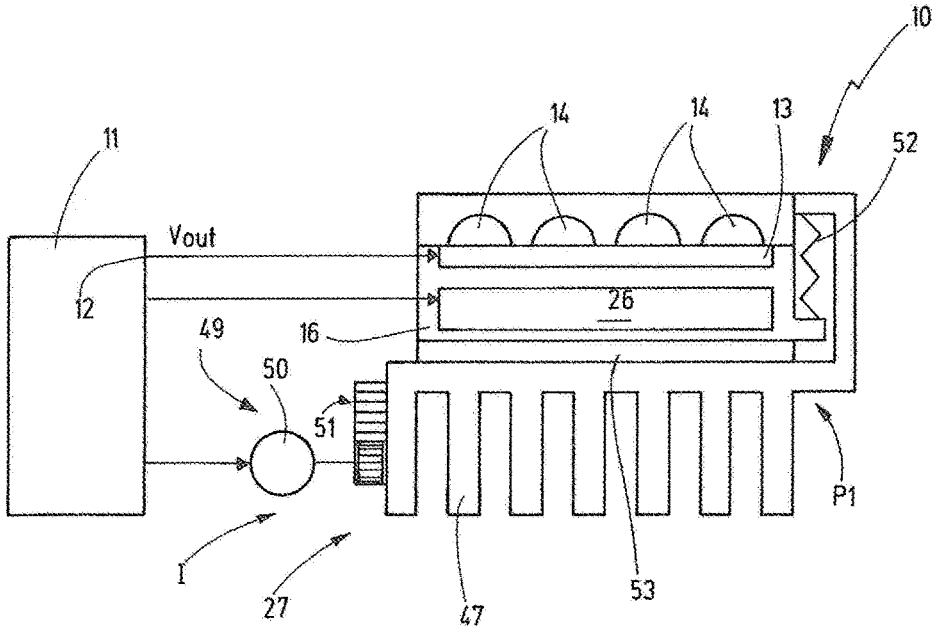
[Fig. 4]
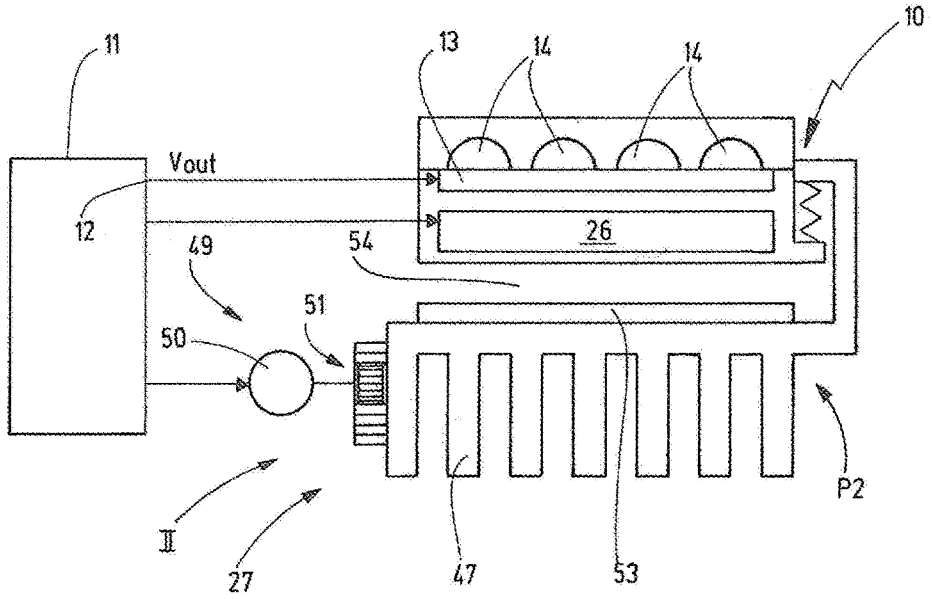

[Fig. 5]
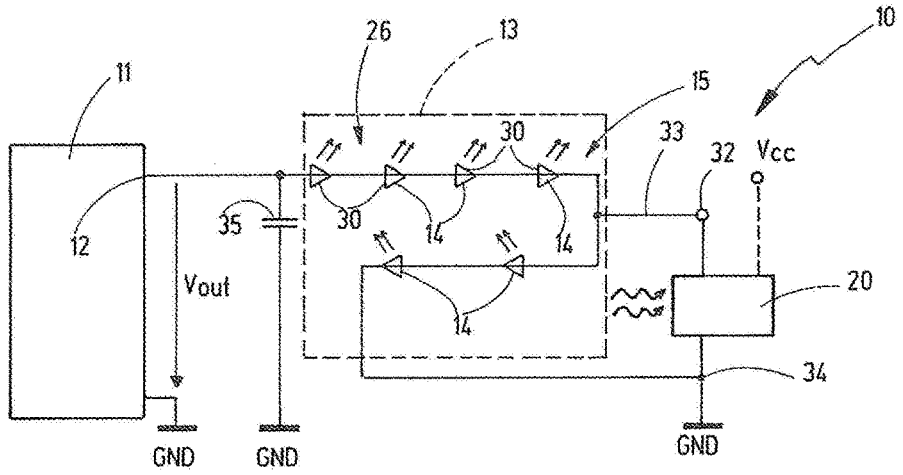
[Fig. 6]
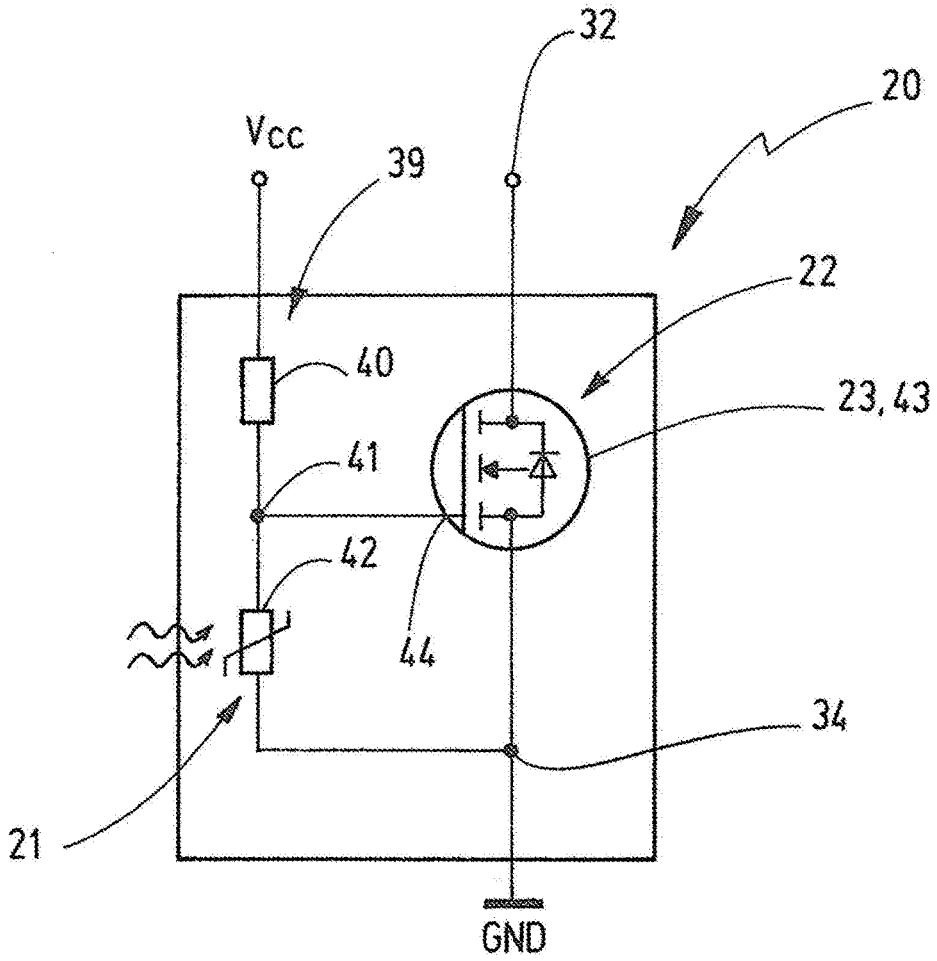

[Fig. 7]
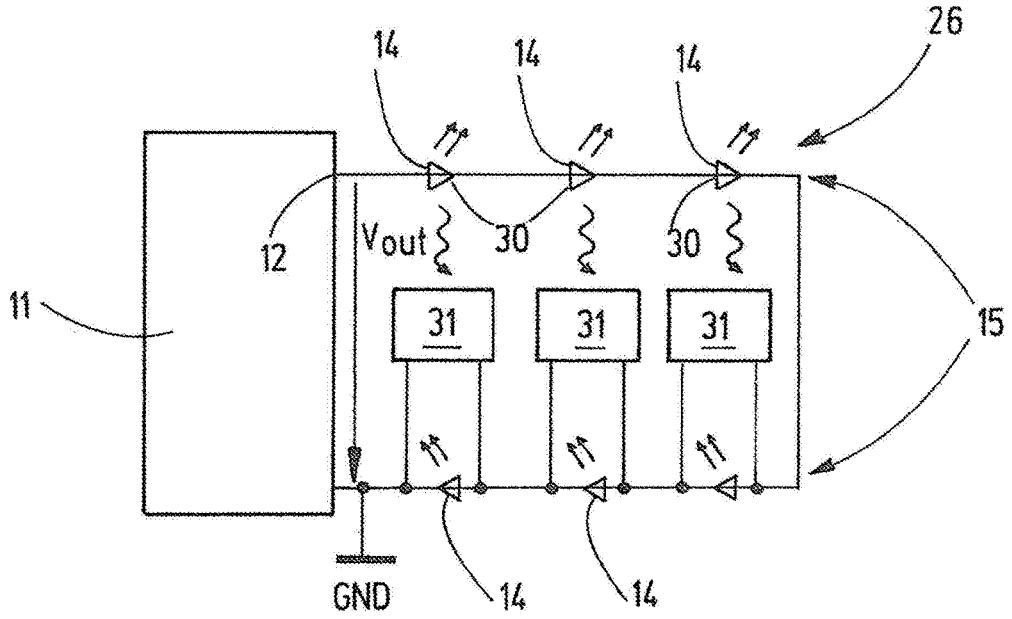
[Fig. 8]
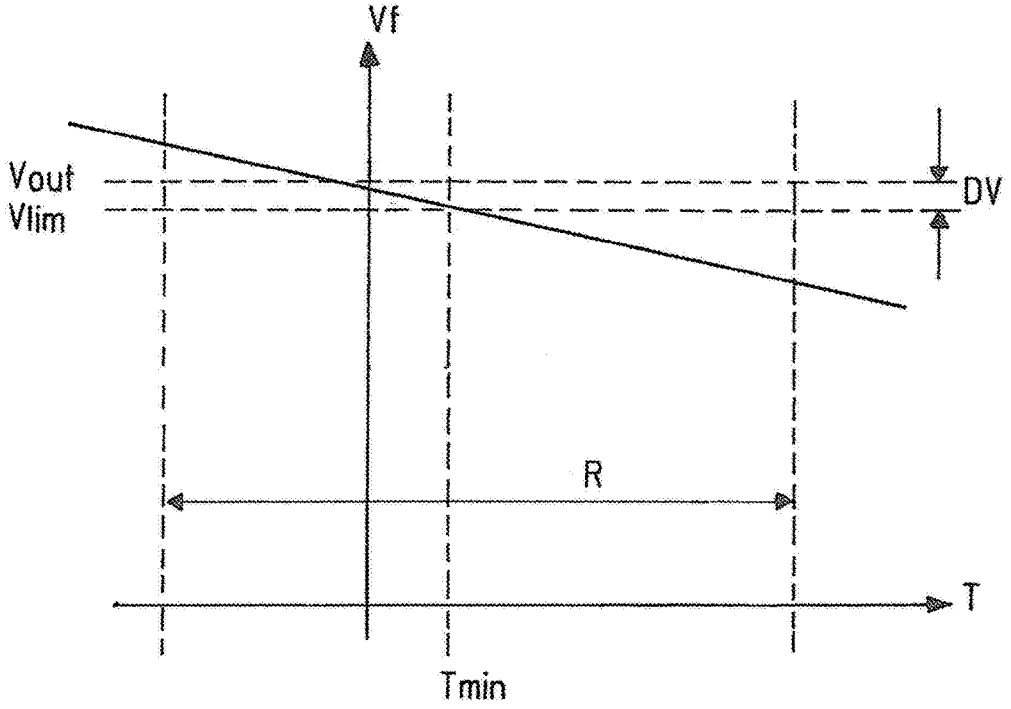

[Fig. 9]
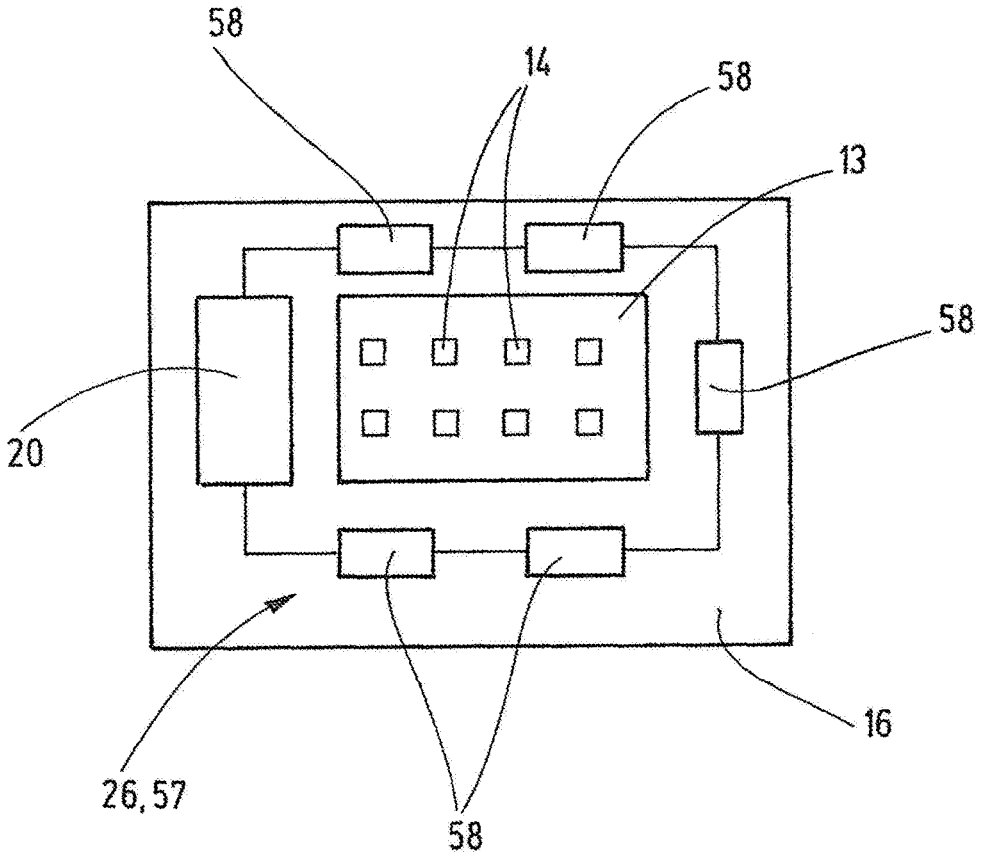

LIGHTING DEVICE AND METHOD FOR OPERATING A LIGHTING DEVICE

TECHNICAL FIELD

The present invention refers to a lighting device and a method for operating the lighting device.

BACKGROUND ART

The lighting device contains a lighting module comprising a light element series connection of at least two semiconductor light elements. Particularly the light elements series connection contains at least four, five or more semiconductor light elements. A drive circuit provides an output voltage and an output current at its output. The output voltage and the output current are supplied to the lighting module to provide electrical energy for lighting the light elements. In a preferred embodiment the semiconductor light elements are light emitting diodes (LEDs) or organic light emitting diodes (OLEDs). The lighting device according the present invention is particularly usable in outdoor applications, for example for illuminating streets, parks, gardens, boardwalks, cycleways or other public or private locations.

Such lighting devices are generally known. DE 10 2009 041 957 A1 discloses a device for operating LEDs. A cooling device is provided to actively cool the LEDs. A temperature sensor can be provided for measuring the temperature of the circuit board, on which the LEDs are mounted. The cooling device can be activated depending on the measured temperature.

US 2007/0108843 A1 discloses a series connected power supply for semiconductor-based vehicle lighting systems. The power supply includes a constant current source to supply current to the semiconductor light elements. For each semiconductor light element a bypass switch is provided. If the bypass switch is closed, the current flows through the bypass switch around the respective semiconductor light element. In so doing a failure of one single semiconductor light element does not affect the lighting of the other semiconductor light elements in the series connection. The bypass switches can also be used for modulating the brightness of the lighting device.

SUMMARY OF INVENTION

Technical Problem

Particularly in outdoor applications, the lighting device is exposed to the environmental conditions and respective temperature variations. Because of such varying environment temperatures a large operating temperature range for the lighting device is required. The forward voltage of the non-illuminated semiconductor light elements changes depending from the temperature of the lighting module. If this forward voltage increases due to a low environment temperature it can happen, that the output voltage of the drive circuit is insufficient to start illumination of the lighting module.

It is therefore the object of the present invention to make sure that lighting of the semiconductor light elements connected in series is possible also when the ambient temperature is low.

Solution to Problem

According to an aspect of the present invention, the lighting device contains a control means having a temperature dependent element. The control means can change its condition. It adopts a heating condition if a heating requirement is fulfilled. Fulfilling the heating requirement requires at least that the temperature of the lighting module has decreased below a predetermined minimum temperature value at which the forward voltage of the light element series connection reaches an upper limit value.

When the control means adopts the heating condition, a heating means is activated to heat the lighting module for increasing the temperature of the lighting module or at least to avoid that the temperature of the lighting module is further lowered. In so doing the lighting device avoids that the output voltage provided by the drive circuit is insufficient to start the illumination of the light element series connection. The temperature of the lighting module is kept in a temperature range in which the forward voltage is lower or at most as high as the output voltage of the drive circuit. Accordingly, the lighting device can be illuminated independent from the environment temperature.

In a preferred embodiment the heating means contains one ore more semiconductor light elements. Preferably at least one of the semiconductor light elements of the light element series connection is used as heating element and thus forms the heating means. This at least one semiconductor light element is lighted if the control means adopts the heating condition. Accordingly, an additional device for heating the lighting module is not necessary. The heat produced by the at least one semiconductor light element is sufficient and used to heat the lighting module. An easy configuration at low costs can be achieved.

Preferably, the control means can be configured to short-circuit at least one of the semiconductor light elements of the light element series connection if the control means adopts the heating condition. A current cannot flow through a short-circuited semiconductor light element. In so doing, the forward voltage of the light element series connection is reduced. Preferably the number of semiconductor light elements which are short-circuited is selected so that the semiconductor light elements, which are not short-circuited, provide a forward voltage of the series connection which is definitely not exceeding the output voltage of the drive circuit over the entire possible operating temperature range under consideration of the expected environment temperature range. In so doing independent from the environment temperature the illumination of at least some of the semiconductor light elements of the light element series connection is possible. The illuminated semiconductor light elements can in such an embodiment be used as heating elements of the heating means for heating the lighting module. After the temperature of the lighting module has increased or is sufficiently raised, the short-circuit of the respective semiconductor light elements can be annulated. Annulating the short-circuit can be performed either sequentially for one short-circuited semiconductor light element after another or for all of the short-circuited semiconductor light element at the same time.

For creating a short-circuit, the control means can comprise at least one bypass element or bypass circuit connected in parallel with the at least one of the semiconductor light elements to be short-circuited. The bypass element or bypass circuit can contain for example at least one of a temperature dependent element, like a resistor or capacitor, a bimetallic element, a silicon sensor element and/or a controllable switch. The temperature dependent element can have a negative or a positive temperature coefficient. The temperature dependent element of the control means can be any temperature dependent electric and/or electronic element having a positive or a negative temperature coefficient so that the temperature or a temperature change can be detected. The controllable switch is for example a transistor, particularly a field-effect transistor.

The control means can also contain a microcontroller for evaluation of a characteristic of the temperature depending element in order to detect the temperature change and/or to determine a temperature value of the lighting module.

The lighting device can contain a module carrier, for example a printed circuit board. The lighting module and the control means can be placed together on this module carrier. In so doing, the wiring of the lighting device is simplified.

In a preferred embodiment of the lighting device the heating means contains an electric and/or electronic heating arrangement. This heating arrangement is thermally coupled with the lighting module. The heating means can for example contain at least one electric heating component like an electrical resistor and/or an electrical heating coil or the like. The heating means can provide radiation heating and/or convection heating and/or conduction heating.

The lighting device can also contain a cooling means. The cooling means can adopt a first condition for cooling the lighting module and a second condition in which the cooling effect is at least reduced. The cooling means can provide cooling via thermal radiation and/or thermal conduction and/or thermal convection. The cooling means can for example contain at least one peltier element for thermoelectric cooling. The cooling means can alternatively or additionally contain a fan. In one embodiment the fan of the cooling means can also be used for heating. Therefore the fan can be part of the heating means and/or the cooling means.

In one embodiment the cooling means can contain a heat sink. In the first condition of the cooling means the heat sink and the lighting module and/or the module carrier are in contact with each other for dissipating heat. A drive, particularly an electric drive can be provided to separate the heat sink from the lighting module and/or the module carrier in the second condition of the cooling means.

Particularly fulfilling the heating requirement requires additionally that the semiconductor light elements of the light element series connection are all switched off. Accordingly the semiconductor light elements are unlighted. During operation, when the semiconductor light elements are lighted, enough heat is produced to avoid that the light module temperature drops below a predetermined lower value.

The heating means can preferably be configured to not only heat the lighting module in the heating condition, but to additionally heat other electric and/or electronic components of the lighting device which are for example arranged on the module carrier, like an electrolytic capacitor and/or a battery and/or an accumulator or the like.

In one embodiment the drive circuit and the control means can be switched into a standby-mode. In this standby-mode the semiconductor light elements are turned off. Preferably after the expiration of a predetermined time interval since the beginning of the standby-mode the control means are activated or waked up to check whether the heating requirement is fulfilled. This check can be performed regularly. If the heating requirement is not fulfilled, the control means are switched back into the standby-mode. Otherwise the control means adopts its heating condition and the lighting module is heated. The heating can be continued for a predetermined duration until a predetermined temperature of the lighting module is reached. After this heating period the lighting device is switched back into the standby-mode unless the lighting of the lighting device is requested for illumination.

The control means for operating the heating means and/or the cooling means contains a temperature depending element. In one embodiment of the invention the control means can additionally contain at least one of the following devices: a device with calendar function, a timing device, a clock, a brightness sensor, a global position sensor, e.g. a satellite based position sensor. Under use of at least one of these devices the control means can determine under consideration of the global location and/or the time and/or the calendar day whether cooling or heating of the lighting module is necessary. Heating of the lighting module can for example be considered to be necessary if the semiconductor light elements are switched off and winter and/or nighttime is determined.

BRIEF DESCRIPTION OF DRAWINGS

Other preferable features of the invention are contained in the dependent claims, the description and the drawing. In the following, preferable embodiments of the invention are explained in detail with reference to the drawing.

FIG. 1 is a schematic block diagram of a first embodiment of the lighting device.

FIG. 2 is a schematic block diagram of a second embodiment of the lighting device.

FIG. 3 is the illustration of a third embodiment of the lighting device in which a cooling means is in a first condition.

FIG. 4 is the illustration of a third embodiment according to FIG. 3 in which the cooling means is in a second condition.

FIG. 5 is a block diagram of a fourth embodiment of the lighting device.

FIG. 6 is a block diagram of an embodiment of the control means according to the fourth embodiment of the lighting device shown in FIG. 5.

FIG. 7 is a block diagram of a fifth embodiment of the lighting device.

FIG. 8 is a schematic illustration of the dependency of the forward voltage Vf of the series connection of semiconductor light elements in the unlit condition depending from the temperature T of a lighting module.

FIG. 9 is a schematic illustration of another embodiment of a heating means.

DESCRIPTION OF EMBODIMENTS

FIG. 1 shows a block diagram of a first embodiment of a lighting device 10. The lighting device 10 contains a drive circuit 11 having an output 12. At its output 12 the drive circuit provides an output voltage Vout. This output voltage Vout can be applied to a lighting module 13 which is connected to the output 12. At the output 12 the drive circuit 11 also supplies an output current for the lighting module 13. The output current can be controlled for brightness control or dimming.

The lighting module 13 contains several semiconductor light elements 14. At least one light element series connection 15 of at least two and particularly at least four or five semiconductor light elements 14 is contained in the lighting module 13. The light element series connection 15 is for example illustrated in FIG. 5 or 7. Different to the illustrated preferred embodiments the lighting module 13 can contain more than one light element series connection 15. The lighting module 13 with its semiconductor light elements 14 is arranged for example on a module carrier 16, which is for example a printed circuit board.

A control means 20 is provided which comprises a temperature dependent element 21. The temperature dependent element 21 is configured to provide a characteristic C that is characteristic for a temperature value and/or the change of a temperature value. In the described preferred embodiments the temperature dependent element 21 is thermally coupled to the lighting module 13 so that the temperature T of the lighting module 13 and/or changes of this temperature T are detected. The temperature dependent element 21 is preferably arranged on the module carrier 16.

The temperature dependent element can have either a negative temperature coefficient or a positive temperature coefficient. Any suitable electric and/or electronic element can be used, such as a temperature dependent resistor, a temperature dependent capacitor, a bimetallic element, any temperature dependent semiconductor element or the like.

The characteristic C of the temperature dependent element 21 is evaluated in the control means 20. The characteristic C can be an electric signal, for example a temperature dependent current or voltage. The characteristic C can also be a mechanic characteristic, for example if the temperature dependent element is a bimetallic element. In this case the characteristic C is the shape and/or length and/or position of the bimetallic element. However the characteristic C depends on the temperature T of the lighting module 13 and can thus be evaluated in an evaluating part 22 of the control means in order to determine the temperature T or temperature changes of the temperature T of the lighting module 13. The evaluating part 22 can contain a microcontroller for evaluating the characteristic C. The evaluating part 22 can be part of the drive circuit 11 and thus it is possible to use a microcontroller of the drive circuit 11 for receiving and evaluating the characteristic C (FIG. 1). Alternatively the evaluating part 22 can be a separate unit preferably arranged on the module carrier 16 (FIG. 2).

The evaluating part 22 of the control means 20 is configured to adopt the control means 20 into a heating condition if a predetermined heating requirement is fulfilled. Adopting the heating condition can be performed by means of a microcontroller and/or a controllable switch 23 and/or the temperature dependent element 21 of the control means 20 (FIG. 6). As controllable switch it is for example possible to use a transistor, such as a bipolar transistor or field-effect transistor. As one illustrative example an enhancement-mode, n-channel MOSFET is shown in FIG. 6.

Lighting device 10 contains a heating means 26 and in the preferred embodiment additionally a cooling means 27. The cooling means 27 is optional. The heating means 26 is arranged on the module carrier 16 and is thermally coupled with the lighting module. The heating means 26 is provided for heating the lighting module 13 if the temperature T of the lighting module 13 is low. The cooling means 27 can be used to dissipate heat from the lighting module 13 if the temperature T of the lighting module 13 is high. Accordingly, the heating means 26 and the cooling means 27 are not operated at the same time.

According to the first embodiment shown in FIG. 1, the heating means and/or the cooling means 27 is controlled by means of the control means 20 which is at least partly integrated in the drive circuit 11. The energy, which is necessary for heating or cooling can be provided by the drive circuit 11. Since both means 26, 27 do not operate at the same time, one common interface 28 of the drive circuit 11 can be used to provide the necessary electric energy for heating or cooling.

Different to the first embodiment shown in FIG. 1, the evaluating part 22 of the control means 20 can be arranged on the module carrier 16 (FIG. 2). The evaluating part 22 can contain a microcontroller and/or a controllable switch 23 and can have any configuration as described above. According to the embodiment of FIG. 2 the heating means 26 is controlled using the control means 20, whereas the necessary electric energy for creating the heat is provided by means of the drive circuit 11 and particularly the interface 28 as explained with regard to the first embodiment of FIG. 1. The lighting device 10 of FIG. 2 can also contain the cooling means 27 as explained with regard to the first embodiment of FIG. 1.

The light element series connection 15 contains several semiconductor light elements 14, for example light emitting diodes (LEDs). The forward voltage Vf depends on the temperature T of the lighting module 13 as schematically illustrated in FIG. 8. Particularly if the lighting device 10 is used in outdoor applications, for example for illumination of streets, gardens, boardwalks, cycleways or other public or private locations the ambient temperature can change remarkably. The lighting device 10 must be able to light the semiconductor light elements 14 independent from the ambient temperature, which is particularly relevant in the non-lighted condition, in which no current flows through the light element series connection 15, so that the semiconductor light elements 14 are not heated. Accordingly the lighting device 10 must be able to light the semiconductor light elements 14 over an entire operating temperature range R, which can for example cover the range from −30 degrees Celsius up to over +120 degrees Celsius. The temperature T of the lighting module 13 can vary over the complete temperature range R. At every temperature value the drive circuit 11 must be able to start lighting.

As illustrated in FIG. 8 the forward voltage Vf of the light element series connection 15 increases with decreasing temperature T. As can be taken from this diagram at very low temperatures T of the lighting module 13 below a minimum temperature value Tmin the forward voltage Vf can exceed the output voltage Vout of the drive circuit 11. Consequently the output voltage Vout would be insufficient to start lighting of the semiconductor light elements 14 of the light element series connection 15. It is undesired to use a drive circuit 11 which is able to provide an output voltage Vout having an amount which is sufficient to start lighting over the entire possible operating temperature range R. Such drive circuit 11 would remarkably increase the costs for the lighting device 10. To solve this problem the heating means 26 are used to heat the lighting module 13 in order to avoid that the forward voltage Vf exceeds the output voltage Vout so that lighting is possible at each temperature.

When the heating requirement is fulfilled, the control means 20 adopt the heating condition. For fulfilling the heating requirement it is at least necessary that the temperature T of the lighting module 13 drops down to the minimum temperature value Tmin. At this minimum temperature value Tmin the forward voltage Vf corresponds to an upper limit value Vlim. For fulfilling the heating requirement it is additionally necessary that the semiconductor light elements 14 of the light element series connection 15 are all switched off so that no current flows through the light element series connection 15.

If the heating requirement is fulfilled, the control means 20 changes to the heating condition and the heating means 26 heats a lighting module 13. In so doing it is possible to avoid that the forward voltage Vf exceeds the output voltage Vout so that lighting of the semiconductor light elements 14 can be guaranteed.

As shown in FIG. 8 it is preferred that the minimum temperature value Tmin is selected so that the amount of the upper limit value Vlim of the forward voltage VF is less than the amount of the output voltage Vout by a predetermined voltage difference DV. If the voltage difference DV has a sufficient amount it can be made sure, that enough time is provided to produce heat for the lighting module 13. It can happen that immediately after the start of the heating, the temperature T of the lighting module continues to decrease. This is because a certain time delay can exist between starting of the heating operation and the production of enough heating energy to stop the temperature T decreasing and/or to start increasing the temperature T.

As shown in the embodiments according to FIGS. 5 through 7 the heating means can be formed by some of the semiconductor light elements 14 of the light element series connection 15. When the semiconductor light elements 14 are lighted by means of a current flowing through the semiconductor light elements 14, not only light but also heat is produced. This heat can be used to heat the lighting module 14. Accordingly some of the semiconductor light elements 14 form heating elements 30. Because it is not necessary or even impossible to use all of the semiconductor light elements 14 as heating elements 30 at least one or more semiconductor light elements 14 are short-circuited by the control means 20 when the control means 20 adapts the heating condition. As shown in FIG. 7, the control means 20 can comprise at least one bypass element 31 which is connected in parallel with at least one of the semiconductor light elements 14 which is not used as heating element 30. It is possible that each of the bypass elements 31 is assigned to one of the semiconductor light elements 14 to be short-circuited.

The bypass element 31 can be formed in one embodiment from a resistor having a positive temperature coefficient so that the resistance increases as the temperature increases. If the temperature T of the lighting module 13 is low, the resistance of the bypass elements 31 is low enough to short-circuit the respective semiconductor light element 14. Only the semiconductor light elements 14 used as heating elements 30 are lighted and produce heat (illustrated schematically by the corrugated arrows in FIG. 7) which heats the lighting module 13 and also increases the resistance of the bypass elements 31. If the temperature T is sufficiently increased the short-circuiting is suspended due to the increase of the resistance. The forward voltage Vf is reduced accordingly and all of the semiconductor light elements 14 of the light element series connection 15 can be lighted.

In a further embodiment shown in FIGS. 5 and 6 the control means 20 is connected via a first node 32 with a tap 33 of the light element series connection 15. The control means 20 is connected via a second node 24 with the ground GND. The light element series connection 15 is connected to the output 12 at one side and to the ground GND at the other side. The control means 20 is used to bypass and short circuit those semiconductor light elements 14 which are connected in parallel with the control means 20 between the tap 33 and the ground GND if the control means 20 is in the heating condition. The other semiconductor light elements 14 which are arranged between the output 12 of the drive circuit 11 and the tap 33 are used as heating elements 30 and thus form the heating means 26. A capacitor 35, for example an electrolytic capacitor, is connected in parallel with the lighting module 13 and/or the light element series connection 15 between the output 12 and the ground GND.

An embodiment of the control means 20 of the embodiment of the lighting device 10 shown in FIG. 5 is illustrated in FIG. 6. A voltage divider 39 is provided containing a first resistor 40 connected via a center tap 41 with the temperature dependent element 21. The temperature dependent element 21 is preferably formed by a temperature dependent resistor 42 having a negative temperature coefficient. The temperature dependent resistor 42 is thermally coupled with the lighting module 13 as illustrated schematically by the corrugated arrows. The voltage divider 39 is connected at the side of the first resistor 40 to a supply voltage Vcc and at the side of the temperature dependent resistor 42 to the ground GND or the second node 34.

The control means 20 further contains the controllable switch 23 which is in this embodiment formed by a field-effect transistor 43. This controllable switch 23 is used as bypass element to short-circuit some of the semiconductor light elements 14 in the heating condition of the control means 20. A control input 44 of the controllable switch 23 is formed by the gate of the field-effect transistor 43. The controllable switch 23 is inserted into the connection between the first node 32 and the second node 34 so that depending on the condition of the controllable switch 23 a conductive connection between the two nodes 32, 34 can be provided or interrupted. In the present embodiment the drain of the field-effect transistor 43 is connected with the first node 32 and the source is connected with the second node 34.

The embodiment of the lighting device 10 shown in FIGS. 5 and 6 works as follows:

When the temperature T of the lighting module 13 decreases and reaches the minimum temperature value Tmin, the resistance of the temperature dependent resistor 42 has increased to a value so that the voltage across the temperature dependent resistor 42 has reached a value which switches the controllable switch 23 in its conductive condition. Accordingly some of the semiconductor light elements 14 which are connected between the tap 33 and the ground GND are short-circuited. In order to heat the lighting module 13 the output voltage Vout is applied to the lighting module 13 so that a current flows through those semiconductor light elements 14 that are used as heating elements 30, via the tap 33 through the controllable switch 23 to the ground GND. The semiconductor light elements 14 used as heating element 30 are lighted and produce heat for heating the lighting module 13. Accordingly a further drop of the temperature T of the lighting module 13 can be prevented.

It is also possible to heat other electric or electronic components, e.g. the electrolytic capacitor 35, of the lighting device 10 by using the heating means 26. Those components are thermally coupled with the heating means 26.

Another embodiment of the lighting device 10 is shown in FIGS. 3 and 4. The light element series connection 15 and the control means 20 can have a configuration shown in any of the embodiments according to FIG. 1, 2, 5, 6 or 7 as explained above. The embodiment shown in FIGS. 3 and 4 has a cooling means 27 containing a heat sink 47. The cooling means 27 can alternatively or additionally contain a fan 48. The heat sink 47 and/or the fan 48 is used for dissipating heat from the lighting module 13 if the semiconductor lighting elements 14 are lighted. Accordingly an undesired increase of the temperature T of the lighting module 13 can be avoided.

The cooling means 27 can adopt a first condition I for cooling the lighting module 13 and a second condition II in which the cooling effect of cooling the lighting module 13 is at least reduced or suspended. For example a fan 48 can be operated in the first condition I whereas in the second condition II the fan 48 is switched off.

In the embodiment according to FIGS. 3 and 4 the cooling means 27 comprises a drive arrangement 49 for moving the heat sink 47 between a first position P1 in the first condition I of the cooling means 27 and a second position P2 in the second condition II of the cooling means 27. The drive arrangement 49 includes in this embodiment an electric drive 50 connected with the heat sink 47 via a gear 51. The gear 51 can for example be formed by a rack and pinion gear.

A spring arrangement 52 is optionally provided and is used to create a spring force which presses the module carrier 16 and/or the lighting module 13 against the heat sink 47 if the cooling means 27 are in the first condition I. Accordingly a good heat conduction or transfer can be provided between the lighting module 13 or the module carrier 16 respectively and the heat sink 47. To improve this thermal coupling a graphite layer 53 can be attached either to the module carrier 16 and/or the lighting module or else to the heat sink 47. The graphite layer 53 is thus arranged between the heat sink 47 and the module carrier 16 and/or the lighting module 13 in the first condition I of the cooling means 27.

The drive arrangement 49 can be operated to move the heat sink 47 against the force of the spring arrangement 52 away from the module carrier 16 or the lighting module 13 and accordingly from the first position P1 into the second position P2. In this second position P2 a gap 54 exists between the module carrier 16 and/or the lighting module 13 and the heat sink 47 so that the thermal dissipation of heat produced in the lighting module 13 via the heat sink 47 is reduced or even completely blocked. Accordingly in the second condition II of the cooling means 27 no or only a negligible cooling effect is provided. The cooling means 27 are changed into this second condition II if the heating requirement is fulfilled and heating of the lighting module 13 is necessary. Preferably the cooling means 27 are kept in the second condition II unless the lighting module 13 or respectively the semiconductor light elements 14 of the lighting module 13 are lighted for illumination and cooling is necessary. This avoids that the heat produced during a heating operation or after the end of a heating operation is dissipated too quickly through the cooling means 27. Such cooling is only necessary when the lighting device 10 is used for illumination and the semiconductor light elements 14 are lighted.

The cooling means 27 with the drive arrangement 49 and the heat sink 47 can be provided in all of the described embodiments. Alternatively and/or additionally the cooling means 27 can comprise a fan 48 in all of the above described embodiments. The fan 28 is rotating in the first condition I of the cooling means 27 whereas the fan 48 is standing still in the second condition II of the cooling means 27. At least one Peltier element can alternatively or additionally be used as thermoelectric cooling element in the cooling means 27 and arranged on the module carrier 16 and/or at the lighting module 13.

The above mentioned embodiments can have a modified heating means 26 having alternatively or additionally a heating arrangement 57 containing at least one heating component 58 as schematically illustrated in FIG. 9. Each heating component 58 can be formed by an electrical resistor and/or an electrical heating coil. The at least one heating component 58 is arranged directly at the lighting module 13 or else on the module carrier 16 and thermally coupled with the lighting module 13. The number of heating component 58 depends on the size and the shape of the lighting module 13 and/or on the heating power of the heating component 58.

Further in all of the described embodiments the lighting device 10 and particularly the drive circuit 11 and the control means 20 can be switched into a standby-mode. During this standby mode it is possible to wake up the control means 20 after a predetermined period of time has expired to check the temperature T of the lighting module 13. If this temperature T has reached or even fallen below the minimum temperature value Tmin the control means 20 adopt its heating condition and the heating of a lighting module 13 is provided as explained above.

The control of the heating and/or cooling can not only depend on the temperature T of the lighting module 13, but can alternatively depend on additional parameters, such as the season, the calendar day, the day time, the global position of the lighting device 10, etc. Accordingly the control means 20 can contain devices such as timing devices, clocks, positioning sensors (for example global satellite based positioning sensors), etc. to provide such parameters. For example the heating duration and/or the heating energy and/or the heating power or the like can be controlled depending on the temperature T and/or one or more of such additional parameters.

The present invention refers to a lighting device 10 and a method of operating this lighting device 10. A lighting module 13 having a light element series connection 15 of several semiconductor light elements 14 is connected to the output 12 of a drive circuit 11. The control means 20 is provided which is configured to adapt a heating condition if a heating requirement is fulfilled. In the heating condition a heating means 26 is activated by the control means 20 to heat the lighting module. The heating requirement is fulfilled when the temperature T of the lighting module 13 drops down to a minimum temperature value Tmin. In so doing an undesired increase of the forward voltage Vf of the light element series connection 15 can be avoided.

REFERENCE SIGNS LIST

10 lighting device
11 drive circuit
12 output
13 lighting module
14 semiconductor light elements
15 light element series connection
16 module carrier
20 control means
21 temperature dependent element
22 evaluating part
23 controllable switch
26 heating means
27 cooling means
28 common interface
30 heating element
31 bypass element
32 first node
33 tap
34 second node
35 capacitor
39 voltage divider
40 first resistor
41 center tap
42 temperature dependent resistor
43 field effect transistor
47 heat sink

48 fan
49 drive arrangement
52 spring arrangement
53 graphite layer
54 gap
57 heating arrangement
58 heating component
I first condition
II second condition
C characteristic of the temperature dependent element
DV difference voltage
P1 first position
P2 second position
R temperature range
T temperature of the lighting module
Tmin minimum temperature value
Vcc supply voltage
Vf forward voltage
Vlim upper limit value of the forward voltage
Vout output voltage

The invention claimed is:

1. A lighting device comprising:

a drive circuit providing an output voltage at the output of the drive circuit, a lighting module connected to the output of the drive circuit having a light element series connection of semiconductor light elements, a control means having a temperature dependent element, wherein the control means adopts a heating condition if a heating requirement is fulfilled, a heating means which is connected with the control means and which is turned on to heat the lighting module if the control means adopts the heating condition, wherein fulfilling the heating requirement requires at least that the temperature of the lighting module has decreased to a minimum temperature value at which the forward voltage of the light element series connection corresponds to an upper limit value, or the temperature of the lighting module has fallen below the minimum temperature value, the control means short-circuits at least one of the semiconductor light elements of the light element series connection if the control means adopts the heating condition, and in the drive circuit and a standby-mode of the control means, the control means are activated after expiration of a predetermined time interval to check whether the heating requirement is fulfilled.

2. The lighting device according to claim 1, wherein the heating means contains one or more semiconductor light elements which are lighted to produce heat for heating the lighting module if the control means adopts the heating condition.

3. The lighting device according to claim 1, wherein the control means comprises at least one bypass element connected in parallel with the at least one of the semiconductor light elements.

4. The lighting device according to claim 1, wherein the control means and the lighting module are placed on one module carrier.

5. The lighting device according to claim 1, wherein the temperature dependent element is a temperature dependent resistor or a bimetallic element.

6. The lighting device according to claim 1, wherein the control means comprise a controllable switch.

7. The lighting device according to claim 1, wherein the heating means contains an electric and/or electronic heating arrangement which is thermally coupled to the lighting module.

8. The lighting device according to claim 1, wherein cooling means are provided which can adopt a first condition for cooling the lighting module and a second condition in which the cooling effect of the lighting module is at least reduced.

9. The lighting device according to claim 8, wherein the cooling means are configured to be switched into the second condition if the heating requirement is fulfilled.

10. The lighting device according to claim 1, wherein fulfilling the heating requirement requires additionally that the semiconductor light elements of light element series connection are switched off.

11. A method for operating a lighting device, the lighting device comprising:

a drive circuit providing a output voltage at the output of the drive circuit, a lighting module connected to the output of the drive circuit having a light element series connection of semiconductor light elements, a control means having a temperature dependent element, a heating means which is connected with the control means, the method comprising the following steps:

changing the control means into a heating condition if a predetermined heating requirement is fulfilled, wherein fulfilling the heating requirement requires at least that the temperature of the lighting module has decreased to a minimum temperature value at which the forward voltage of the light element series connection corresponds to an upper limit value, or the temperature of the lighting module has fallen below the minimum temperature value, heating the lighting module when the control means adopts the heating condition, the control means short-circuiting at least one of the semiconductor light elements of the light element series connection if the control means adopts the heating condition, and in the drive circuit and a standby-mode of the control means, activating the control means after expiration of a predetermined time interval to check whether the heating requirement is fulfilled.

* * * * *